United States Patent [19]

Turner et al.

[11] Patent Number: 4,886,013

[45] Date of Patent: Dec. 12, 1989

[54] MODULAR CAN COATING APPARATUS

[75] Inventors: James J. Turner, Amherst; Guy H. McMillan, Elyria, both of Ohio; Joseph A. E. Pintelon, Lennik, Belgium; Joseph C. Waryu; James L. Kennon, both of Amherst, Ohio; Peter E. Muller, Aesch, Switzerland

[73] Assignee: Nordson Corporation, Westlake, Ohio

[21] Appl. No.: 296,438

[22] Filed: Jan. 12, 1989

[51] Int. Cl.[4] ..... B05C 1/02; B05C 7/02

[52] U.S. Cl. ..... 118/668; 118/699; 118/306

[58] Field of Search ..... 118/306, 312, 317, 668, 118/699, 682, 669; 228/18

[56] References Cited

U.S. PATENT DOCUMENTS

| | | | |
|---|---|---|---|
| 2,220,107 | 11/1940 | Holloway | 118/317 |
| 2,693,782 | 11/1954 | Moore | 118/317 |
| 2,760,465 | 8/1956 | Hawkins | 118/317 |
| 2,798,456 | 7/1957 | Pearson | 118/317 |
| 2,846,972 | 8/1958 | Bofinger | 118/317 |
| 2,859,729 | 11/1958 | Socke | 118/317 |
| 3,135,629 | 6/1964 | McLean | 118/408 |
| 3,702,107 | 11/1972 | Rood et al. | 118/684 |
| 3,788,561 | 1/1974 | Vilagi et al. | 264/67 |
| 3,816,165 | 6/1974 | Horvath et al. | 118/306 |
| 3,816,165 | 6/1974 | Horvath et al. | 427/236 |
| 3,921,570 | 11/1975 | Hogstrom et al. | 118/685 |
| 4,170,192 | 10/1979 | Maddock | 118/306 |
| 4,180,011 | 12/1979 | Halicki | 118/685 |
| 4,215,648 | 8/1980 | Stamets et al. | 118/306 |
| 4,337,281 | 6/1982 | Boone | 427/236 |
| 4,353,326 | 10/1982 | Kolibas | 118/696 |
| 4,430,886 | 2/1984 | Rood | 73/37 |

*Primary Examiner*—Willard Hoag

*Attorney, Agent, or Firm*—Wood, Herron & Evans

[57] ABSTRACT

A coating apparatus for applying a stripe of fluid coating material over the longitudinal seams of a series of can bodies moving along a can forming line with the coating apparatus within the interior of the can bodies including a fluid manifold module removably secured to an end cap member and communicating with sources of air and fluid coating material under pressure through the end cap member, a coating module removable secured to said end cap member and having a pneumatically operated valve therein for selectively opening and closing a fluid flow passageway to control the discharge of coating material onto the seams of can bodies, and preferably a solenoid valve mounted in the air flow passageway in the fluid manifold module adjacent the coating module for controlling the flow of air to operate the coating material valve. The coating apparatus having the solenoid mounted directly adjacent the coating module is characterized by its relatevely high cycle rates and relatevely small diameter with the overall coating apparatus being very easy to disassemble for maintenance, repair or replacement of components.

11 Claims, 2 Drawing Sheets

MODULAR CAN COATING APPARATUS

BACKGROUND OF THE INVENTION

This invention relates to the application of protective coatings to the interior seams of cans and, more particularly, to a modular can coater, particularly a relatively small diameter modular can coater, for applying protective coatings to the interior of the welded seams of cans.

Metal cans are generally made by either of one or two processes. One process, the two-piece can process, involves forming a drawn cup from a flat sheet of metal by a blanking process and further forming the cup to a can configuration by an ironing process. The other process, the three-piece process, involves forming a cylindrical can body from a sheet of metal and then attaching two lids to the opposite ends of the body. In the manufacture of three-piece cans, the cylindrical can bodies are formed by wrapping a sheet of metal around a so-called stubhorn. The ends of the sheet are either butted or overlapped and secured together by a welded seam, a soldered seam or a cemented seam. The interior of the seam is then coated with a protective coating which protects the contents of the can against the metal contaminants. The coating is applied to insure that no metal is exposed to the contents of the can. The present invention is directed to apparatus for applying this continuous coating onto can seams.

In a standard production line for the production of cylindrical can bodies by the three-piece process, a stubhorn is provided which acts as a mandrel around which can bodies are formed from a metal blank as they pass downstream over the stubhorn. The can bodies are moved longitudinally over the stubhorn from a magazine by suitable conveyor means such as lugs of a chain conveyor which engage the rear edge of the can bodies and push the can bodies along the stubhorn or a magnetic conveyor wherein moving belts carrying magnets engage the metal cans to move them along the stubhorn. In the final stages of the movement of the can bodies over the stubhorn, the ends of the sheet metal are brought together and joined. The bodies are seamed together by a weld at a welding station. As the bodies pass off the stubhorn and onto rails, they are pushed through an inside striping station. At this station, a stripe of protective material is sprayed over the inside seam of the can. From the striping station, the can body is advanced along a series of rails for further processing such as curing of the coating.

The striping station includes an airless spray apparatus secured to the end of the stubhorn. This apparatus is so positioned that the can bodies pass over it before passing onto to the rails. The spray apparatus is secured to the stubhorn and extends from the downstream end of the stubhorn and includes a nozzle from which the coating material is sprayed along the seam of the can as it passes thereover.

Such can seam coating apparatus exist in commerce today. The flow of coating material through the apparatus is controlled by an air operated valve such that the liquid spray from the coating apparatus is turned on and off in synchronization with movement of the can bodies over the stubhorn. That is, the coating or spray apparatus is activated by the air pressure line extending to the apparatus only when the can seam is passing over the nozzle and is deactivated between cans. For example, a continuously moving line of four-inch long cans may be separated by half-inch gaps. Accordingly, it is necessary to turn the spray apparatus on and off so as not to spray coating material into the gaps. With production lines running at speeds on the order of up to 700 to 750 cans per minute, the cycle rate of the spray apparatus becomes quite high. In known can seam coaters, the air line controlling the coater came in far upstream of the coater on the order of 10 to 12 feet at a minimum. The need to pressurize an air line of this length has resulted in limitations in the cycle rate of the coating apparatus.

There are also can coating systems where the cans are butted end to end during coating to eliminate the gaps between cans so that there is no need to cycle the gun on and off.

Existing can coaters have a diameter on the order of 1 ¾ to 2 inches. With the increasing use of smaller diameter cans, e.g., aerosol cans used in the cosmetics industry, there is a need for a relatively small diameter can coater on the order of 30 mm in diameter. Such a small diameter can coater would be useful both in systems where the gun is rapidly cycled on and off and in systems where it is not.

Likewise, in both types of systems, there is a need for spray apparatus which when secured to the end of the stubhorn can be easily disassembled for maintenance, repair or replacement.

SUMMARY OF THE INVENTION

The present invention is directed to a small diameter modular can coating apparatus capable of high speed operation with fast response time and is easily disassembled for maintenance and repair. In accordance with a presently preferred form of the invention, a fluid manifold module is provided which is supported at the rear by a mounting rod from the stubhorn of the can forming apparatus. Air inlet and fluid inlet and outlet lines are brazed to an end cap attached to the rear of the manifold module having fluid flow passageways communicating with fluid flow passageways in the manifold module. A microminiature solenoid is mounted in the manifold module, and a coating module is attached to the forward or downstream end of the manifold module. Coating material passageways extend through the manifold module to the coating module, and an air flow passageway selectively openable and closeable by the solenoid extends through the manifold module. Electric lines go to the solenoid in the manifold module and control the flow of air therethrough. When the solenoid is actuated, air is supplied through the module to the coater module to open a nozzle permitting the spray of can coating material on the inner seam of cans passing over the nozzle. The can coater can be easily assembled and disassembled, and the solenoid can be quickly and easily replaced as needed. Since the solenoid is mounted directly adjacent the coating module, the response time is increased, and the coater can cycle at relatively high cycle rates. In addition, the modular can coating apparatus has a diameter of only about 30 mm permitting its use with relatively small diameter cans, and is easily disassembled for maintenance and repair due to its modular construction.

DETAILED DESCRIPTION OF THE INVENTION

Figure 1:
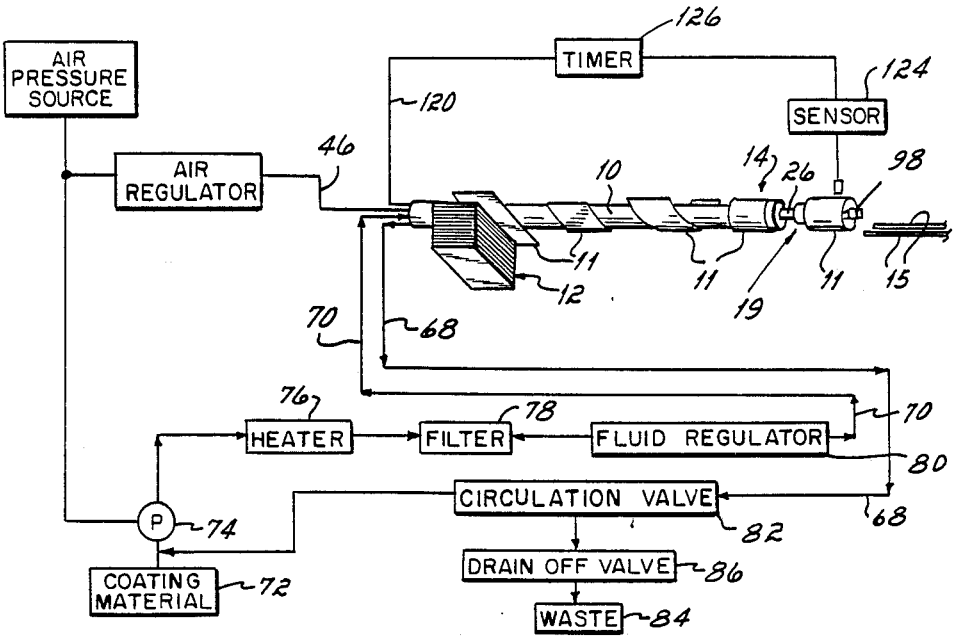
FIG. 1 is a diagrammatic illustration of a can body production line in which the can coating apparatus of the present invention is employed.

Referring first to FIG. 1, there is illustrated diagrammatically a standard can production line used in the production of cylindrical can bodies in the three-piece can process. This line includes a stubhorn 10 which acts as a mandrel around which can bodies 11 are formed as they pass downstream over the stubhorn 10. The can bodies 11 are moved longitudinally over the stubhorn 10 from a magazine 12 by means of a conveyor (not shown) such as the lugs of a chain conveyor or a magnetic conveyor which engage the can bodies and push the can bodies along the stubhorn.

In the final stage of movement of the can bodies 11 over the stubhorn 10, the ends of the sheet metal are abutted or overlapped and joined. The bodies are seamed together by a weld at a welding station indicated generally by the numeral 14. As the can bodies 11 pass off the stubhorn 10 and onto rails 15, they pass over the can coating apparatus of the present invention indicated generally at 19. At this station, a stripe of protective material is sprayed over the interior seams of the cans as will be more fully described hereinafter. From the striping station, the can bodies advance along the series of rails 15 for further processing such as curing of the coating material sprayed thereon.

Figure 2:
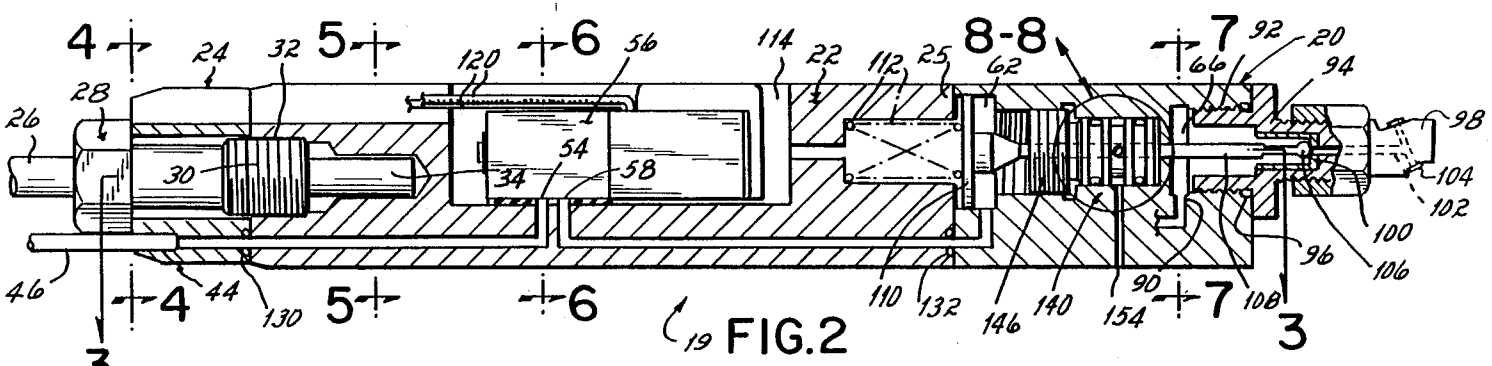
FIG. 2 is a cross-sectional view of the can coating apparatus of the present invention.
Figure 5:
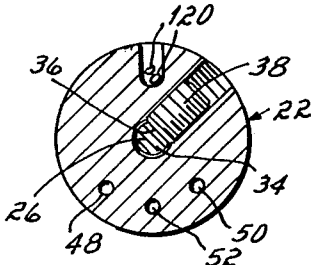
FIG. 5 is a view taken along line 5—5 of FIG. 2.

Referring now to FIG. 2, the can coating apparatus 19 of the present invention comprises a coater module 20, a fluid manifold module 22, and an end cap 24. The coater module 20 is secured to the forward or downstream end of the fluid manifold module 22 by means of external screws (not shown) extending through the body of the coater module 20 and into the downstream end 25 of the fluid module 22. The can coater 19 is mounted to the stubhorn 10 by means of a mounting rod 26 secured at one end (not shown) to the downstream end of the stubhorn 10. The other end of the mounting rod 26 passes through an end cap retainer 28 which has a threaded section 30 which screws into an internally threaded bore 32 in the end of the fluid manifold 22. Tightening of the end cap retainer 28 in the fluid manifold 22 secures the end cap 24 in position on the end of the fluid manifold 22. As shown more clearly in FIG. 5, the end 34 of the mounting rod 26 extending into the end of the fluid manifold 22 includes a flat 36. A set screw 38 in the wall of the fluid manifold 22 is engageable with the flat 36 to secure the fluid manifold module 22 of the spray apparatus 19 to the mounting rod end 34 and in turn to the stubhorn 10.

Figure 3:
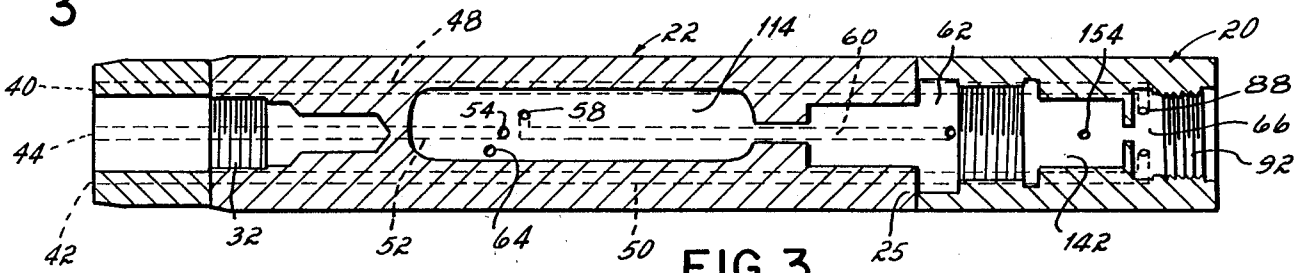
FIG. 3 is a view taken along line 3—3 of FIG. 2.
Figure 7:
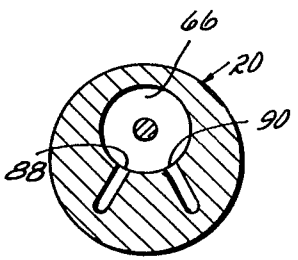
FIG. 7 is a view taken along line 7—7 of FIG. 2.
Figure 6:
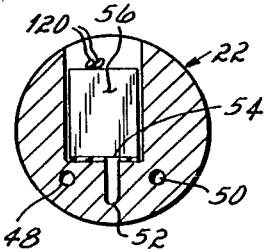
FIG. 6 is a view taken along line 6—6 of FIG. 2.
Figure 4:
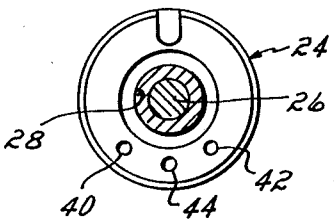
FIG. 4 is a view taken along line 4—4 of FIG. 2.

The end cap 24 includes a fluid inlet port 40, a fluid outlet port 42, and an air inlet port 44 (FIGS. 3 and 4). Tubes, such as the air tube 46 shown in FIG. 2, are brazed in the respective inlet and outlet ports to make the fittings between the sources of coating fluid and air and the fluid flow lines within the coating apparatus 19. The fluid inlet port 40 communicates with a fluid flow passageway 48 which extends through the end cap 24, through the length of the fluid manifold 22, and into the coater module 20 (FIG. 3). Likewise, the fluid outlet 42 port communicates with a fluid flow passageway 50 that extends from the coater module 20, back along the length of the fluid manifold 22, and through the end cap 24. The air inlet 44 communicates with an air passage 52 which extends through the end cap 24, along the fluid manifold 22, and to an inlet port 54 to an electrical solenoid valve 56. When the electric solenoid valve is actuated, air introduced through port 54 is directed into a port 58 and through an air passageway 60 into a piston chamber 62 in the rearward end of the coater module 20 as hereinafter described. When the electrical solenoid valve 56 is deactivated, the air is exhausted to atmosphere through port 64 (FIG. 3) in the fluid manifold module 22.

As shown in FIGS. 1-3, the can coating apparatus 19 includes provision for continuously circulating the coating material through the coater. That is, there is a continuous flow of fluid or coating material to the coater 19 through the fluid inlet 40 which communicates with the fluid flow passageway 48 in the fluid manifold 22 and coater module 20 to a fluid chamber 66 at the forward end of the coater module 20. There is also a continuous flow of coating material from the fluid chamber 66 back through the return passageway 50 and out the fluid outlet 42 to a return line 68 (FIG. 1). As a result of this continuous flow, the temperature of the coating material may be maintained constant in the coater even when the apparatus is not in use and the fluid would otherwise be stationary. Since some coating materials are applied at a temperature substantially above room temperature, it is important that they not be permitted to stand and become hardened in the coater. The circulating flow of fluid through the spray apparatus precludes this hardening or the setting of the coating material.

As shown diagrammatically in FIG. 1, a fluid inlet line 70 entering the coater 19 through port 40 originates at a source 72 of coating material which is caused by a pump 74 to pass through a heater 76, a filter 78, and a regulator 80 to the spray apparatus 9 via lines within the stubhorn 10. The return line 68 directs coating material to a circulation valve 82 which either directs the fluid back to the inlet to pump 74 or to a waste receptacle 84 by way of a drain off valve 86. Thus, fluid introduced into the spray apparatus from line 70 through inlet 40 passes through passageway 48 along the length of the coater exiting through a port 88 (FIG. 3) and into the fluid chamber 66. Fluid in the chamber 66 may be recirculated back to the fluid outlet port 42 by passing through a fluid outlet port 90 at the fluid chamber 66 and back along passageway 50.

Referring again to FIGS. 2 and 3, the coater module 20 includes at its forward end an internally threaded bore 92 into which is threaded a valve tip 94. An 0-ring 96 seals the valve tip 94 in the bore 92 in the coater module 20. A fluid spray tip 98 is in turn threaded on the en of the valve tip 94. A counterbore in the valve tip 94 defines the fluid chamber 66, which communicates at its rearward end with the fluid inlet and outlet passageways 48 and 50 through ports 88 and 90, respectively. The valve tip 94 includes at its forward end a valve 100 which in the valve open position permits fluid coating material under pressure to flow from the fluid chamber 66 through valve 100 along a passageway 102 in the spray tip 98 and out a spray orifice 104 which is directed at an angle suitable for striping of the inside seams of cans passing thereon.

Control of fluid flow through the valve 100 is by means of a needle 106 which includes a shaft 108 terminating at its rearward end in a piston 110. The needle 106 is biased to a valve closed position by means of a spring 112 located in the forward end of the fluid manifold 22. The piston 110 moves in the piston chamber 62 in a rearward direction when air is introduced into the piston chamber 62 on actuation of the electrical solenoid valve 56. Movement of the piston draws the needle tip 106 out of its seat in the valve 100 permitting flow of fluid through the valve 100 to the spray orifice 104.

Flow of air to the piston chamber 62 is controlled by an electrical solenoid valve 56. This valve is located in a slot 114 in the fluid manifold 22 adjacent the coater module 20 of the gun. Since the solenoid is mounted directly adjacent the module 20 containing the piston chamber 62, response time is increased and the apparatus can cycle at a very high rate. That is, it has been found that the apparatus of the present invention can cycle at a rate sufficient to spray coat four-inch cans separated by half-inch gaps moving at a rate of up to 750 cans per minute whereas older coaters were able to operate only at cycle rates for a similar line moving at a rate of 300 to 400 cans per minute.

A suitable solenoid valve 56 is a four-way microminiature valve approximately 1.81 inches long by 0.71 inches high available from Nordson Corporation as Part No. 112,149 having the following specifications:

| | |
|---|---|
| Valve Type: | Four-way poppet, two-position, single solenoid |
| Flow Rate: | 5 scfm $\pi$ 100 psi |
| CV Factor: | 0.04 |
| Voltage: | 12 v DC or 24 v DC |
| Power Consumption: | 2.0 watts nominal |
| Operating Pressure Range: | 0.2 psi to 120 psi |
| Response Time: | .005 seconds on-.005 seconds off |

Note while this valve as manufactured has one input port, two output ports, and two exhaust ports, as used in this invention, as described above only the one input port, one output port and one exhaust port are used.

Electric lines 120 pass along the length of the stubhorn 10 to the solenoid 56 in the fluid module to control the flow of air through the fluid manifold 22.

The opening of a valve 100 to emit liquid spray from the spray orifice 104 is controlled in synchronization with movement of the can bodies 11 over the stubhorn 10 (FIG. 1). Activation of the gun is initiated by suitable sensor means, for example, by a proximity sensor 124 which detects the leading edge of each can. Upon each detection of the leading edge of a can, the sensor 124 sends an electrical pulse to a timer circuit 126. The timer circuit 126 in accordance with preprogrammed input then, after a set delay time, sends a signal to the solenoid valve 56 causing the valve to open to permit flow of air through passageway 60 and into piston chamber 62. The increase in air pressure in chamber 62 works on the piston 110 to compress spring 112. Movement of the needle 106 toward the spring 112 opens valve 100 causing coating material to be emitted from the fluid chamber 66 under pressure through the valve 100, out the spray orifice 104, and onto the seam of the passing can body 11.

After a predetermined time which is a function of can length and conveyor speed, that can which had activated the proximity sensor passes out of alignment with the spray orifice. After that predetermined time, the timer circuit 126 interrupts the signal to the solenoid 56 causing it to be deenergized and the control circuit to be reset. Upon deenergization of the solenoid 56, flow of air to the piston chamber 62 stops and the air is exhausted through the exhaust port 64 in the fluid manifold 22. This sequence is repeated each time a can body passes the proximity sensor 124.

All air and fluid lines between modules of the apparatus are sealed by O-rings, e.g., O-ring 130 between end cap 24 and fluid manifold module 22 and O-ring 132 between fluid manifold module 22 and coater module 20.

In operation, the fluid coating material to be sprayed on the can seam passes through the inlet port 40 in the end cap 24 and along the fluid passageway 48 in the fluid manifold module 22 and coater module 20 entering the fluid chamber 66 in the coater body. When the valve 100 is in the valve closed position, the fluid continuously circulates back along the fluid outlet passageway 50 and to the circulation valve 82 as described above. When the timing circuit is actuated, an electrical signal opens the solenoid valve 56. Air under pressure entering the end cap 24 through port 44 passes through the air passageway 52 in the fluid manifold 22 to the solenoid 56 and then through the second air passageway 60 to the piston chamber 62. The force of the air on the piston head 110 compresses the spring 112 and draws the needle 106 out of its seating engagement with the valve 100 thereby permitting the flow of the coating material out of the fluid chamber 66 through the valve 100 to the spray orifice 104. When the can has been coated, the timer 126 removes the electrical signal to the solenoid valve 56 causing it to close. Air to the piston chamber 62 is immediately turned off and the pressurized air is vented through the exhaust port 64 until the solenoid 56 is actuated once again. As stated above, the mounting of the solenoid 56 directly adjacent the coater module 20 markedly increases the response time and results in high cycle rates.

Figure 8:
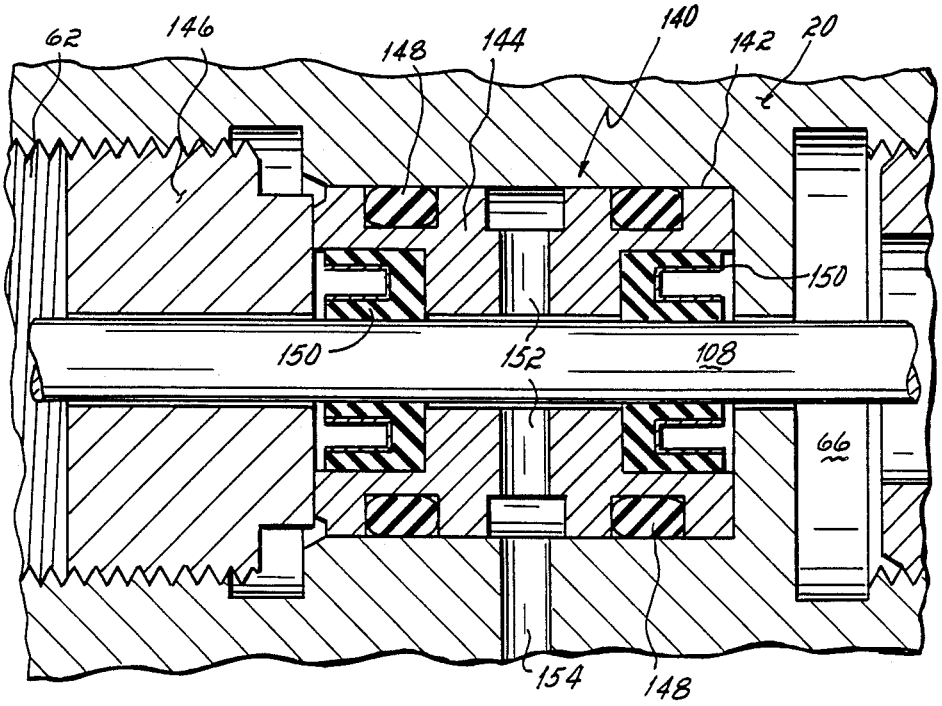
FIG. 8 is an enlarged view of a portion of FIG. 2 taken at line 8—8.

Referring now to FIG. 8, there is shown an enlargement of a sealing arrangement 140 for sealing the shaft 108 of needle 106 while permitting reciprocal movement for opening and closing valve 100. This arrangement includes a seal cavity 142 which is formed in the coater module 20. A seal holder 144 is mounted in the seal cavity 142. A retainer 146 is threaded into the module 20 from its rearward or upstream end to retain the seal holder 144 in the seal cavity 142. O-rings 148 are carried on the seal holder 144 to seal the seal holder 144 to the module 20. The needle shaft 108 is sealed to seal holder 144 by means of annular spring seals 150 which have a generally U-shaped cross-sectional configuration. The seal holder 144 includes a weep hole 152, which communicates with a weep hole 154 in the module 20 so that if air bypasses the spring seal 150 or O-ring 148, it exits the gun body through the weep hole 154 and does not enter the coating material chamber 66. Likewise, if coating material passes the spring seal 150 or O-ring 148, it exits through the weep hole 154 so that it does not enter the air chamber 62.

One of the features of the present invention is the ability of the coating apparatus to be easily assembled and disassembled for maintenance and replacement of gun parts. That is, the solenoid 56 is mounted in the slot 114 in the fluid manifold module 22 so that it can be easily replaced. If it is necessary to replace the valve 100, this can be accomplished merely by unscrewing the fluid tip 98 and the valve tip 94. Replacement of the needle shaft seal 140 can be accomplished by merely removing the screws securing the coater module 20 to the fluid manifold module 22, removing the retainer 146 from the rear end of the module 20, and then removing the seal structure 140 from the seal cavity 142. The fluid manifold module 22 can be removed by unscrewing the end cap retainer 28 and releasing the set screw 38.

Thus having described the invention, what is claimed is:

1. Coating apparatus for applying a stripe of fluid coating material over the longitudinal seams of a series of spaced can bodies moving along a can forming line, said coating apparatus being adapted to fit within the interior of said can bodies and comprising:

a fluid manifold module communicating at its upstream end with sources of air and fluid coating material under pressure and having an air flow passageway and a fluid flow passageway extending along its length for flow of air and fluid coating material, respectively, to its downstream end;

a coating module mounted to said downstream end of said fluid module and communicating with at least said fluid flow passageway;

pneumatically operable valve means in said coating module selectively movable to a valve open and a valve closed position for permitting the flow of said fluid coating material in said valve open position through said fluid flow passageway for discharge onto said seams of said can bodies; and a solenoid valve mounted in said fluid manifold module in communication with said air flow passageway to control the flow of air through said air flow passage to selectively open and close said valve means.

2. The coating apparatus of claim 1 further comprising an end cap mounted to the upstream end of said fluid manifold module and including a fluid inlet port and an air inlet port for receiving a fluid inlet line and an air inlet line, respectively, at the upstream end thereof and further including a fluid flow passageway and an air flow passageway communicating at the downstream end thereof with the upstream end of said fluid flow passageway and said air flow passageway, respectively, of said fluid manifold module.

3. The coating apparatus of claim 2 further comprising a throughopening in said end cap and a counterbore in said upstream end of said fluid manifold module for receiving a mounting rod for mounting said coating apparatus to said can forming line.

4. The coating apparatus of claim 1 further comprising a second fluid flow passageway extending along the length of said fluid manifold module having an inlet end communicating with said coating module and an outlet end at said upstream end of said fluid manifold module for permitting in combination with said fluid flow passageway of said fluid module the recirculation of said fluid coating material through said coating module.

5. The coating apparatus of claim 1 wherein said pneumatically operable valve means comprises a needle and seat valve, including a seat valve at the downstream end of said coating module, a needle having an end for seating on said seat valve and a shaft longitudinally reciprocal in said coating module terminating at its end opposite the end seating said seat valve in a piston, and a spring biasing said valve means to said valve closed position; and a piston chamber containing said piston and communicating with said air flow passageway of said fluid manifold module for receiving air under pressure on opening of said solenoid valve to thereby compress said spring and lift said needle from said seat valve permitting flow of fluid coating material through said seat valve for discharge onto said seams of said can bodies.

6. The coating apparatus of claim 5 further comprising means for sealing said shaft of said needle in said coating module including a seal holder mounted in a counterbore in said fluid module and having an upstream end and a downstream end and throughopening therebetween communicating with a weephole passing through the wall of said coating module, first and second seal means for sealing the interface between the seal holder and the coating module on either side of said throughopening in said seal holder, first and second seal means for sealing the shaft of said needle about its circumference on either side of said through-opening in said seal holder while permitting its longitudinal reciprocation, and retainer means for retaining said seal holder in said counterbore in said fluid module.

7. Coating apparatus for applying a stripe of fluid coating material over the longitudinal seams of a series of can bodies moving along a can forming line, said coating apparatus being adapted to fit within the interior of said can bodies and comprising:

an end cap having a fluid inlet supply conduit and an air inlet supply conduit secured thereto, and having a fluid supply port and an air supply port on the opposite side thereof in communication with said fluid supply conduit and said air supply conduit, respectively;

a fluid manifold module removably secured to said end cap at its upstream end, and having an air flow passageway communicating with said air supply port, and a fluid flow passageway communicating with said fluid supply port, both of said passageways extending along the length of said module for flow of air and fluid coating material, respectively, therethrough to its downstream end;

a coating module removably secured to said downstream end of said fluid module, said coating module including a fluid chamber communicating through a passageway in said coating module with said fluid flow passageway in said fluid module, and a piston chamber communicating through a passageway in said coating module with said air flow passageway in said fluid module; and a fluid spray nozzle communicating with said fluid chamber through pneumatically operable valve means in said coating module selectively movable between a valve open and a valve closed position by means of the introduction of air under pressure to said piston chamber for permitting the flow of said fluid coating material from said fluid chamber through said valve means to said fluid spray nozzle for discharge on said seams of said can bodies.

8. The coating apparatus of claim 7 further comprising a solenoid valve mounted in a recess in the wall of said fluid manifold module and communicating with said air flow passageway in said fluid module to control the flow of air to said piston chamber to selectively open and close said valve means.

9. A coating apparatus for applying a stripe of fluid coating material over the longitudinal seams of a series of spaced can bodies moving along a can forming line, said coating apparatus being adapted to fit within the interior of said can bodies and comprising:

a fluid manifold module communicating at its upstream end with a source of air and fluid coating material under pressure and having first and second air flow passageways and a fluid flow passageway, said fluid flow passageway extending along the length of said fluid manifold module, said first air flow passageway communicating at its upstream end with said source of air and terminating in an outlet port, said second air flow passageway having an inlet port and extending to the downstream end of said fluid manifold;

a coating module mounted to the downstream end of said fluid module and including a counterbore at its upstream end defining a piston chamber and an air flow passageway in said coating module communicating and extending between said piston chamber and the downstream end of said second air flow passageway in said fluid module;

a fluid tip mounted in the downstream end of said coating module having at its upstream end a fluid chamber and at its downstream end a seat valve;

a fluid flow passageway in said coating module communicating with said fluid flow passageway in said fluid manifold module for delivering fluid coating material under pressure to said fluid chamber;

a spray orifice at the downstream end of said fluid tip and communicating with said fluid chamber through said seat valve;

a needle longitudinally reciprocal within said coating module having a downstream end adapted to seat on said seat valve and having at its upstream end a piston reciprocal in said piston chamber;

spring means for biasing said needle to a normal valve closed position wherein said needle seats on said seat valve;

a solenoid valve mounted in a recess in said fluid manifold module having an inlet communicating with said outlet end of said first air flow passageway and an outlet communicating with the inlet of said second air flow passageway to control the flow of air therethrough to said piston chamber to selectively introduce air under pressure into said piston chamber to compress said spring means to thereby withdraw said needle from said seat valve permitting the flow of fluid coating material through said seat valve to said spray orifice.

10. The coating apparatus of claim 9 further comprising means for sealing said shaft of said needle in said coating module including a seal holder mounted in a counterbore in said fluid module and having an upstream end and a downstream end and throughopening therebetween communicating with a weephole passing through the wall of said coating module, first and second seal means for sealing the interface between the seal holder and the coating module on either side of said throughopening in said seal holder, first and second seal means for sealing the shaft of said needle about its circumference on either side of said throughopening in said seal holder while permitting its longitudinal reciprocation, and retainer means for retaining said seal holder in said counterbore in said fluid module.

11. The coating apparatus of claim 9 further comprising a second fluid flow passageway extending along the length of said fluid manifold module having an inlet end communicating with said coating module and an outlet end at said upstream end of said fluid manifold module for permitting in combination with said fluid flow passageway of said fluid module the recirculation of said fluid coating material through said coating module.

* * * * *